US005133886A

United States Patent [19]

Hata

[11] Patent Number: 5,133,886

[45] Date of Patent: Jul. 28, 1992

[54] ADDITIVE FOR LUBRICATING OIL AND LUBRICATING OIL COMPOSITION CONTAINING SAID ADDITIVE

[75] Inventor: Hitoshi Hata, Ichihara, Japan

[73] Assignee: Idemitsu Kosan Co., Ltd, Chiyoda, Japan

[21] Appl. No.: 748,017

[22] Filed: Aug. 21, 1991

[30] Foreign Application Priority Data

Aug. 28, 1990 [JP] Japan ..... 2-224371

[51] Int. Cl.[5] ..... C10M 125/10; C10M 141/02

[52] U.S. Cl. ..... 252/25; 252/32.7 E; 252/56 R

[58] Field of Search ..... 252/25, 32.7 E, 56 R

[56] References Cited

U.S. PATENT DOCUMENTS 3,290,249 12/1966 Wilson ..... 252/25

3,935,114 1/1976 Donaho Jr. ..... 252/25

FOREIGN PATENT DOCUMENTS 502935 6/1976 U.S.S.R. ..... 252/26

*Primary Examiner*—Jacqueline Howard

*Attorney, Agent, or Firm*—Antonelli, Terry, Stout & Kraus

[57] ABSTRACT

Disclosed herein is an additive for lubricating oil which comprises a zinc dithiophosphate, a compound having at least one hydroxyl group and carbon-carbon double bond in a molecule thereof and cuprous oxide.

Also disclosed herein a lubricating oil composition which comprises a base oil for lubricating oil and the above-mentioned additive for lubricating oil.

The aforementioned additive is particularly effective for improving color change to black, sludge formation, stability a against oxidation and anti-wear property for zinc dithiophosphate (ZnDTP)-compound lubricating oil composition.

12 Claims, No Drawings

ADDITIVE FOR LUBRICATING OIL AND LUBRICATING OIL COMPOSITION CONTAINING SAID ADDITIVE

BACKGROUND OF THE INVENTION 1. Field of the Invention

The present invention relates to an additive for lubricating oil and a lubricating oil composition containing said additive. More particularly, it pertains to an additive for lubricating oil which is suitably used for hydraulic fluid, traction drive oil, bearing oil, engine oil, etc. and a lubricating oil composition compounded with said additive. 2. Description of the Related Arts In general, a zinc dithiophosphate (ZnDTP) which is used as an antioxidant and an anti-wear additive suffers a disadvantage that, when compounded in a lubricating oil used at a high temperature, it is highly apt to turn to a black color and further deposit-sludges.

As methods of overcoming such a disadvantage, several attempts have been made including (1) the alteration of alkyl and aryl groups in ZnDTP, (2) the alternation of alkyl and aryl species such as difference in primary, or secondary compound, difference in carbon numbers or the like, and (3) improvement in the process for producing and purifying ZnDTP, etc.

Nevertheless, the above-mentioned attempts are still incapable of suppressing the tendency of turning to a black color when the above ZnDTP is compounded in a lubricating oil used at a temperature higher than 100° C., therefore, the aforementioned problem remains unsolved.

As the other method of overcoming the disadvantage, there is available a method of employing ZnDTP in combination with a detergent dispersant, thus solubilizing the decomposition product of ZnDTP. However the above-mentioned method is also incapable of suppressing the tendency of turning to a black color.

In order to solve the disadvantage of the foregoing prior art, intensive research has been made by the present inventor on the development of a novel technique capable of suppressing the tendency of turning to a black color and sludge deposition even when ZnDTP is compounded in a lubricating oil used at a high temperature.

SUMMARY OF THE INVENTION

It is an object of the present invention to provide a novel additive for lubricating oil, which additive is capable of suppressing the tendency of turning to a black color and improving the stability against oxidation and anti-wear property for ZnDTP-compounded base oil.

It is another object of the present invention to provide a ZnDTP-compounded lubricating oil composition without the tendency of turning to a black color, which composition is much improved in stability against oxidation and anti-wear property.

Other objects and advantages of the present invention will become apparent from the detailed description to follow taken in conjunction with the appended claims.

According to the first aspect of the present invention, there is provided an additive for lubricating oil comprising a zinc dithiophosphate (ZnDTP) (Component A), a compound having at least one hydroxyl group and carbon-carbon double bond in a molecule thereof (Component B) and cuprous oxide (Component C). In addition, according to the second aspect of the present invention, there is provided a lubricating oil composition comprising a base oil for lubricating oil and said additive compounded therein.

DESCRIPTION OF PREFFERRED EMBODIMENT

A zinc dithiophosphate (ZnDTP) used in the additive of the present invention as component A is represented by the formula

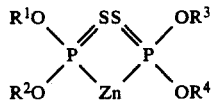

wherein $R^1$ to $R^4$ are each a primary or secondary alkyl group having 2 to 30 carbon atoms, an aryl group having 6 to 30 carbon atoms, a cycloalkyl group having 6 to 30 carbon atoms or alkylaryl group having 6 to 30 carbon atoms. In addition to the compound of the above-mentioned formula, widely marketed ZnDTP can be used as component A. Specific examples of ZnDTPs include zinc dialkyldithiophosphate such as zinc di-n-propyldithiophosphate, zinc di-isopropyldithiophosphate, zinc di-n-butyldithiophosphate, zinc di-isobutyldithiophosphate, zinc di-sec-butyldithiophosphate, zinc di-n-amyldithiophosphate, zinc di-isoamyldithiophosphate, zinc di-n-hexyldithiophosphate, zinc di(2-ethylhexyl) dithiophosphate, zinc didecyldithiophosphate, etc.; zinc diaryldithiophosphate such as zinc diphenyldithiophosphate, etc.; and zinc dialkylaryldithiophosphate such as zinc dioctylphenyldithiophosphate, zinc dinonylphenyldithiophosphate, zinc didodecylphenyldithiophosphate, etc.

There are available a variety of compounds each having at least one hydroxy group (OH) and carbon-carbon double bond (C=C) in a molecule thereof used in the additive of the present invention as component B. They are exemplified by an unsaturated aliphatic alcohol having 10 to 30 carbon atoms, a partially esterified compound formed by an unsaturated aliphatic acid having 10 to 30 carbon atoms and a polyhydric alcohol having 2 to 10 carbon atoms, etc. The aforementioned unsaturated aliphatic alcohol is preferably the one having an iodine value of 50 or more and specifically exemplified by cis-11-hexadecene-1-ol, cis-9-octadecene-1-ol (oleyl alcohol), 3,7,11,15-tetramethyl-2-hexadecene-1-ol, 9-eiconsene-1-ol (eicosenol), 11-docosene-1-ol, 13-docosene-1-ol, 12-tetracosane-1-ol, 13-tetracosene-1-ol, etc. Among them 9-eicosene-1-ol(eicosenol), 11-docosene-1-ol, 13-docosene-1-ol and cis-9-octadecene-1-ol (oleyl alcohol) are particularly desirable.

The foregoing partially esterified compound formed by an unsaturated aliphatic acid having 10 to 30 carbon atoms and a polyhydric alcohol having 2 to 10 carbon atoms is exemplified by sorbitan (mono to tri) oleate, mono to nona) oleate of poly (tetra to deca) glycerol, trimethylol-propane (mono, di) oleate, pentaerythritol mono to tri) oleate, etc.

Component C of the additive according to the present invention is limited to cuprous oxide ($Cu_2O$) only, and the use of cupric oxide or metallic copper can not attain any of the objects of the present invention.

As mentioned hereinbefore, the additive according to the present invention comprises the above-mentioned components A, B and C, but the content ratio of each of the components is not specifically limited, but may be suitably selected according to the purpose of use, required performance, etc. of the additive. However, usually 10 to 300 parts by weight, preferably 20 to 200 parts by weight of component B, and usually 0.5 to 30 parts by weight, preferably 1 to 20 parts by weight of component C are compounded based on 100 parts by weight of component A. In particular, in the case where component C is purified by means of heating and mixing followed by filtration, said component C is preferably contained by 30 to 10,000 ppm as converted to metallic copper based on the total amount of the additive.

When the content ratio of component B or C is too low, insufficient color-change resistance is caused for ZnDTP. On the other hand, when the content ratio thereof is too high, increase in the effect of the present invention with increase in the content ratio is not expected. Furthermore, excessive content ratio of component C lowers the filterability of said component when purified by filtration causing various troubles.

It is preferable that the additive according to the present invention be produced by heating the components A, B and C with mixing all together at 20° to 130° C., preferably 30° to 120° C.

It is also desirable to filter the product obtained by the above heating with mixing as needed to remove solid copper component.

Aside from the above-mentioned additive, the second aspect of the present invention provides a lubricating oil composition comprising a base oil for lubricating oil and said additive compounded therein. The base oil for lubricating oil to be used in the invention may be selected from a variety of base oils that have heretofore been used without specific limitation. There are usually employed, however, mineral oils or synthetic oils each having a kinematic viscosity at 40° C. of 5 to 10,000 cSt. A variety of mineral oils can be used as the base oil so long as they meet the foregoing requirement, and are exemplified by lubricating oil distillate from petroleum oil which has been refined by means of solvent refining, hydrogenation refining, clay contact refining or a combination thereof; high aromatic distillate and hydrogenated product thereof obtained by solvent extraction of a lubricating oil and the like. Examples of synthetic oils include alkylated aromatic compounds, poly-α-olefin oils, ester oils, diester oils, hindered ester oils, synthetic naphthenic oils, polyglycol oils, mixtures thereof, and the like.

The compounding ratio of the above-mentioned additive in the lubricating oil composition according to the second aspect of the present invention is not specifically limited, but may be suitably selected according to the situation. However, usually 0.1 to 5 parts by weight, preferably 0.2 to 3 parts by weight of the above-mentioned additive is compounded based on 100 parts by weight of a lubricating oil composition.

In the lubricating oil composition according to the second aspect of the present invention, other conventionally used additives such as an anti-oxidant, viscosity index improver, corrosion inhibitor, rust preventive, metal deactivator, antifoamer, detergent dispersant or the like may be suitably compounded in a proper content ratio as necessary.

The additive and lubricating oil composition according to the present invention are highly effective for improving the tendency of color change to black, stability against oxidation and anti-wear property for ZnDTP-compounded oil.

The present invention will be better understood by reference to the following examples and comparative examples, which examples are included herein for the purpose of illustration and are not intended to limit the invention thereto.

EXAMPLES 1-19 AND COMPARATIVE EXAMPLES 1-9

To 150 Neutral Oil produced by Idemitsu Kosan Co., Ltd. was added each of the additives having the composition as listed in the pertinent column of Table 1 so that ZnDTP is contained by 0.5% by weight to prepare each sample oil. Coloration and color change properties were determined by the following procedure for each sample oil.

Determination Method for Coloration and Color Change Properties

Coloration and color change properties were determined for 20 g of each sample oil at a testing temperature (oil temperature) of 160° C. by the use of a copper wire (1.6 mm in diameter and 10 cm in length) as the catalyst according to JIS K 2540 "Testing method for thermal stability of lubricating oil".

The sample oil thus tested was taken out every 12 hours, subjected to color test according to ASTM and JIS K 2580 and evaluated by the length of time (hours) exceeding ASTM Color No. 4. The results are listed in Table 1.

TABLE 1

| | | Example 1 | Example 2 | Example 3 | Example 4 | Example 5 | Example 6 | Example 7 |
|---|---|---|---|---|---|---|---|---|
| Component A (parts by weight) | primary-alkyl-ZnDTP*1 | 100 | 100 | 100 | 100 | 100 | 100 | 100 |
| | sec-alkyl-ZnDTP*2 | — | — | — | — | — | — | — |
| | alkylaryl-ZnDTP*3 | — | — | — | — | — | — | — |
| Component B (parts by weight) | oleyl alcohol*4 | 100 | 100 | 100 | 100 | 10 | 60 | 100 |
| | eicosenol*5 | — | — | — | — | — | — | — |
| | decaglyn*6 | — | — | — | — | — | — | — |
| | lauryl alcohol*7 | — | — | — | — | — | — | — |
| | α-olefin*8 | — | — | — | — | — | — | — |
| Component C (parts by weight) | cuprous oxide*9 | 2 | 6 | 10 | 20 | 8 | 8 | 8 |
| | cupric oxide*9 | — | — | — | — | — | — | — |
| | copper powder*9 | — | — | — | — | — | — | — |
| Heating with stirring | time (hr.) | 1 | 1 | 1 | 1 | 1 | 1 | 1 |
| | temperature (°C.) | 100 | 100 | 100 | 100 | 80 | 80 | 80 |
| | copper content in filtrate (ppm) | 475 | 1820 | 3120 | 4650 | 2810 | 1160 | 948 |
| Coloration and color change (hr.) | without catalyst | 60 | 72 | 72 | 60 | 48 | 48 | 72 |
| | with catalyst | 48 | 60 | 72 | 60 | 36 | 48 | 72 |
| | | Example 8 | Comparative Example 1 | Comparative Example 2 | Comparative Example 3 | Comparative Example 4 | Comparative Example 5 | |

TABLE 1-continued

| | | | | | | | |
|---|---|---|---|---|---|---|---|
| Component A (parts by weight) | primary-alkyl-ZnDTP*1 | 100 | 100 | 100 | 100 | 100 | 100 |
| | sec-alkyl-ZnDTP*2 | — | — | — | — | — | — |
| | alkylaryl-ZnDTP*3 | — | — | — | — | — | — |
| Component B (parts by weight) | oleyl alcohol*4 | 200 | 100 | 100 | — | — | — |
| | eicosenol*5 | — | — | — | — | — | — |
| | decaglyn*6 | — | — | — | — | — | — |
| | lauryl alcohol*7 | — | — | — | 100 | — | — |
| | α-olefin*8 | — | — | — | — | 100 | — |
| Component C (parts by weight) | cuprous oxide*9 | 8 | — | — | 8 | 8 | 8 |
| | cupric oxide*9 | — | 8 | — | — | — | — |
| | copper powder*9 | — | — | 8 | — | — | — |
| Heating with stirring | time (hr.) | 1 | 1 | 1 | 1 | 1 | 1 |
| | temperature (°C.) | 80 | 80 | 80 | 80 | 80 | 80 |
| | copper content in filtrate (ppm) | 873 | 5 | 55 | 3630 | 163 | 285 |
| Coloration and color change (hr.) | without catalyst | 72 | 12 | 12 | 36 | 36 | 24 |
| | with catalyst | 72 | 12 | 24 | 36 | 36 | 24 |

| | | Example 9 | Example 10 | Example 11 | Example 12 | Example 13 | Example 14 |
|---|---|---|---|---|---|---|---|
| Component A (parts by weight) | primary-alkyl-ZnDTP*1 | 100 | 100 | 100 | 100 | 100 | 100 |
| | sec-alkyl-ZnDTP*2 | — | — | — | — | — | — |
| | alkylaryl-ZnDTP*3 | — | — | — | — | — | — |
| Component B (parts by weight) | oleyl alcohol*4 | 100 | 100 | 100 | 100 | 100 | 100 |
| | eicosenol*5 | — | — | — | — | — | — |
| | decaglyn*6 | — | — | — | — | — | — |
| | lauryl alcohol*7 | — | — | — | — | — | — |
| | α-olefin*8 | — | — | — | — | — | — |
| Component C (parts by weight) | cuprous oxide*9 | 8 | 8 | 8 | 8 | 8 | 8 |
| | cupric oxide*9 | — | — | — | — | — | — |
| | copper powder*9 | — | — | — | — | — | — |
| Heating with stirring | time (hr.) | 2 | 3 | 5 | 1 | 1 | 1 |
| | temperature (°C.) | 80 | 80 | 80 | 40 | 60 | 100 |
| | copper content in filtrate (ppm) | 1410 | 2330 | 3240 | 210 | 396 | 2150 |
| Coloration and color change (hr.) | without catalyst | 72 | 84 | 72 | 48 | 60 | 72 |
| | with catalyst | 72 | 72 | 72 | 48 | 60 | 72 |

| | | Example 15 | Comparative Example 6 | Comparative Example 7 | Example 16 | Comparative Example 8 | Example 17 |
|---|---|---|---|---|---|---|---|
| Component A (parts by weight) | primary-alkyl-ZnDTP*1 | 100 | 100 | 100 | — | — | — |
| | sec-alkyl-ZnDTP*2 | — | — | — | 100 | 100 | — |
| | alkylaryl-ZnDTP*3 | — | — | — | — | — | 100 |
| Component B (parts by weight) | oleyl alcohol*4 | 100 | 100 | — | 100 | — | 100 |
| | eicosenol*5 | — | — | — | — | — | — |
| | decaglyn*6 | — | — | — | — | — | — |
| | lauryl alcohol*7 | — | — | — | — | — | — |
| | α-olefin*8 | — | — | — | — | — | — |
| Component C (parts by weight) | cuprous oxide*9 | 8 | — | — | 8 | — | 8 |
| | cupric oxide*9 | — | — | — | — | — | — |
| | copper powder*9 | — | — | — | — | — | — |
| Heating with stirring | time (hr.) | 1 | — | — | 1 | — | 1 |
| | temperature (°C.) | 120 | — | — | 80 | — | 80 |
| | copper content in filtrate (ppm) | 7430 | — | — | 297 | — | 56 |
| Coloration and color change (hr.) | without catalyst | 72 | 36 | 12 | 24 | 12> | 36 |
| | with catalyst | 60 | 48 | 24 | 24 | 12> | 36 |

| | | Comparative Example 9 | Example 18 | Example 19 |
|---|---|---|---|---|
| Component A (parts by weight) | primary-alkyl-ZnDTP*1 | — | 100 | 100 |
| | sec-alkyl-ZnDTP*2 | — | — | — |
| | alkylaryl-ZnDTP*3 | 100 | — | — |
| Component B (parts by weight) | oleyl alcohol*4 | — | — | — |
| | eicosenol*5 | — | 100 | — |
| | decaglyn*6 | — | — | 100 |
| | lauryl alcohol*7 | — | — | — |
| | α-olefin*8 | — | — | — |
| Component C (parts by weight) | cuprous oxide*9 | — | 8 | 8 |
| | cupric oxide*9 | — | — | — |
| | copper powder*9 | — | — | — |
| Heating with stirring | time (hr.) | — | 1 | 1 |
| | temperature (°C.) | — | 80 | 80 |
| | copper content in filtrate (ppm) | — | 763 | 6230 |
| Coloration and | without catalyst | 12 | 72 | 60 |

TABLE 1-continued

| | | | | |
|---|---|---|---|---|
| color change (hr.) | with catalyst | 12 | 72 | 60 |

*[1]Zinc dialkyldithiophosphate, Tradename: OLOA 267, produced by Chevron Chemical Co., Ltd.
*[2]Zinc di-sec-hexyldithiophosphate, Tradename: Lubrizol 677A, produced by Lubrizol Corporation
*[3]Tradename: OLOA 260, produced by Chevron Chemical Co., Ltd.
*[4]Produced by Kyowa Oils & Fats Industries Co., Ltd.
*[5]Produced by Kyowa Oils & Fats Industries Co., Ltd.
*[6]Octaoleic acid - decaglycerol (Produced by Japan Surfactant Industries Co., Ltd.)
*[7]Produced by Kao Co., Ltd.
*[8]Produced by Idemitsu Petrochemical Co., Ltd.
*[9]Chemical reagent, produced by Wako Pure Chemicals Co., Ltd.

What is claimed is:

1. An additive for lubricating oil which comprises a zinc dithiophosphate (component A), a compound selected from the group consisting of unsaturated aliphatic alcohol having 10 to 30 carbon atoms and partially esterified compound formed by unsaturated aliphatic acid having 10 to 30 carbon atoms and polyhydric alcohol having 2 to 10 carbon atoms (component B) in an amount of 10 to 300 parts by weight based on 100 parts by weight of said component A and cuprous oxide (component C) in an amount of 0.5 to 30 parts by weight of said component A.

2. The additive according to claim 1, wherein said components A, B and C are subjected to heating with mixing.

3. The additive according to claim 1, wherein said components A, B, C are subjected to heating with mixing followed by filtration to purify said additive.

4. The additive according to claim 1, wherein said component A is at least one compound selected from the group consisting of zinc dialkyldithiophosphate, zinc diaryldithiophosphate and zinc dialkylaryldithiophosphate.

5. The additive according to claim 1, wherein said component B is at least one compound selected from the group consisting of cis-11-hexadecene-1-ol, cis-9-octadecene-1-ol (oleyl alcohol), 3,7,11,15-tetramethyl-2-hexadecene-1-ol, 9-eicosens-1-ol (eicosenol), 11-docosens-1-ol, 13-docosens-1-ol, 12-tetracosane-1-ol, 13-tetracosene-1-ol, sorbitan (mono to tri) oleate, (mono to nona) oleate of poly (tetra to deca) glycerol, trimethylol-propane (mono, di) oleate and pentaerythritol (mono to tri) oleate.

6. The additive according to claim 2, wherein said heating is effected at a temperature in the range of 20° to 130° C. for 10 minutes to 10 hours.

7. The additive to claim 3, wherein said heating is effect at a temperature in the range of 20° to 130° C. for 10 minutes to 10 hours.

8. A lubricating oil composition which comprises a base oil for lubricating oil and an additive for lubricating oil compounded therein, which additive comprises a zinc dithiophosphate (component A), a compound selected from the group consisting of unsaturated aliphatic alcohol having 10 to 30 carbon atoms and partially esterified compound formed by unsaturated aliphatic acid having 10 to 30 carbon atoms and polyhydric alcohol having 2 to 10 carbon atoms (component B) in an amount of 10 to 300 parts by weight based on 100 parts by weight of said component A and cuprous oxide (component C) in an amount of 0.5 to 30 parts by weight of said component A.

9. The composition according to claim 8, wherein said component B is at least one compound selected from the group consisting of cis-11-hexadecene-1-ol, cis-9-octadecene-1-ol (oleyl alcohol), 3,7,11,15-tetramethyl-2-hexadecene-1-ol, 9-eicosens-1-ol (eicosenol), 11-docosene-1-ol, 13-docosene-1-ol, 12-tetracosane-1-ol, 13-tetracosene-1-ol, sorbitan (mono to tri) oleate, (mono to nona) oleate of poly (tetra to deca) glycerol, trimethylol-propane (mono, di) oleate and pentaerythritol (mono to tri) oleate.

10. The composition according to claim 8, wherein said base oil is mineral oil, synthetic oil or mixture thereof.

11. The composition according to claim 8, wherein said composition contains 0.1 to 5 parts by weight of said additive based on 100 parts by weight of said composition.

12. The composition according to claim 8, wherein said component A is at least one compound selected from the group consisting of zinc dialkyldithiophosphate, zinc diaryldithiophosphate and zinc dialkylaryldithiophosphate.

* * * * *